US007584970B2

(12) United States Patent
Ponce

(10) Patent No.: US 7,584,970 B2
(45) Date of Patent: Sep. 8, 2009

(54) WATER-CLOSET COMPOUND GASKET

(75) Inventor: Gabriel Omar Ponce, Florida—Buenos Aires (AR)

(73) Assignee: PEG S.A., Buenos Aires (AR)

( * ) Notice: Subject to any disclaimer, the term of this patent is extended or adjusted under 35 U.S.C. 154(b) by 0 days.

(21) Appl. No.: 11/019,342

(22) Filed: Dec. 21, 2004

(65) Prior Publication Data

US 2005/0184471 A1 Aug. 25, 2005

Related U.S. Application Data

(60) Continuation-in-part of application No. 10/251,363, filed on Sep. 18, 2002, now abandoned, and a division of application No. 10/251,363, filed on Sep. 18, 2002, now abandoned.

(30) Foreign Application Priority Data

Sep. 19, 2001 (AR) ..... P010104432
Sep. 13, 2002 (AR) ..... P020103486

(51) Int. Cl.

| | |
|---|---|
| ***F16L 5/02*** | (2006.01) |
| ***F16L 17/073*** | (2006.01) |
| ***E03D 11/16*** | (2006.01) |
| ***E03D 11/00*** | (2006.01) |
| ***F16L 17/00*** | (2006.01) |

(52) U.S. Cl. ..... 277/606; 277/609; 277/612; 277/616; 277/627; 277/644; 4/252.4; 52/171.1; 52/302.3

(58) Field of Classification Search ..... 277/602, 277/606–607, 609, 648, 626–628, 612, 616, 277/630, 634, 641, 644; 4/252.1, 252.4–252.6; 52/171.1, 302.3, 220.8

See application file for complete search history.

(56) References Cited

U.S. PATENT DOCUMENTS

| | | | | |
|---|---|---|---|---|
| 1,533,444 | A * | 4/1925 | Mohr | 4/252.1 |
| 2,976,543 | A * | 3/1961 | Turner et al. | 4/252.6 |
| 5,432,957 | A * | 7/1995 | Fernie et al. | 4/252.4 |
| 5,937,450 | A * | 8/1999 | Jones | 4/252.1 |
| 6,644,670 | B2 * | 11/2003 | Etcheverry | 277/606 |
| 6,789,275 | B2 * | 9/2004 | Spells et al. | 4/252.5 |

FOREIGN PATENT DOCUMENTS

JP 08333790 A * 12/1996

* cited by examiner

*Primary Examiner*—Vishal Patel
(74) *Attorney, Agent, or Firm*—Evelyn A. Defillo; Defillo & Associates, Inc

(57) ABSTRACT

A one-piece water-closet gasket (21) comprises an outer gasket (39) for the stand (41) and an inner gasket (43) for sealing the outlet of the water-closet drain-duct (29) to the sewage inlet duct (37). The latter gasket comprises a tube (51) having a lower span (53) for plugging into the sewage inlet and is provided with means (55, 57) elastically bearing and sealing against the inner wall surface of the sewage duct.

5 Claims, 5 Drawing Sheets

WATER-CLOSET COMPOUND GASKET

CROSS-REFERENCE TO RELATED APPLICATION

The present patent application is a divisional/continuation-in-part of my now-abandoned U.S. patent application Ser. No. 10/251,363 filed on Sep. 18, 2002. It is requested that my parent application Ser. No. 10/251,363 filed on Sep. 18, 2002 now abaodoned, be incorporated by reference into and as a part of this present Continuation-in-Part application.

FIELD OF THE INVENTION

A water-closet ("w.c.", "toilet" or "loo") comprises a bowl made of glassed porcelain or the like having a pan formed therein for collecting feces, urine and like human exudates. The top of the pan is connected to the end of a water pipe for flushing the pan and carrying away the substances deposited therein. A drain pipe leads off from the bottom of the pan and through a syphon or hydraulic trap down to an outlet opening at the bottom of the bowl such that, when the water-closet is installed, the outlet opening faces down into the inlet hole of a sewage drain-pipe in the floor of the bathroom.

The present invention concerns a gasket for sealing the connection between the drain-pipe of the water-closet and the sewage drain-pipe in the floor for pre-venting water and the bodily wastes from leaking out and soiling the floor, thereby assisting in bathroom upkeep and hygiene. Of course, the gasket may find other applications in similar sanitary fixtures, such as bidets and urinals, having drainage means passing through the floor or like building surface.

BRIEF REVIEW OF THE PRIOR ART

To install a water-closet on the bathroom floor is not a difficult task. The bowl is placed directly on the floor to which it is anchored by a set of bolts, such that the drain-pipe is located right on top of the sewer pipe inlet at floor level. Sealing is carried out to prevent soiling of the floor around the water-closet by means of a rubber gasket the top end of which is affixed to the drain duct and its bottom end rests resiliently against the floor.

This bottom end of a conventional gasket may include three concentric rings the free circumferential edges of which bear against the floor to prevent passage of fluid and wastes outwards.

The conventional sealing means are prone to irregularities on the floor surface, which one generally tries to overcome by adding some sealer material to make up for the unevenness of the floor. However, the material eventually loses its sealing properties with time as the material ages and because of micromovements which happen in the course of normal use of the water-closet, among other reasons.

U.S. Pat. No. 2,976,543 discloses a water-closet gasket having an upper disk for sealing the water-closet's drain-hole against the floor and a tubular seal featuring external resilient circumferential rings sealing against the wall of the sewer pipe on the bathroom floor. This gasket only prevents soiled liquid that is being flushed down the drain connection from spilling out onto the floor but does not prevent liquid on the floor from seeping under the closet stand, such as when the floor is washed.

Commonly assigned U.S. Pat. No. 6,644,670 discloses an outer gasket section for sealing the water-closet stand against the surface of the bathroom floor. The embodiment of FIG. 9 integrates the aforementioned oblong outer gasket section with an annular inner sealing section for simultaneously sealing the supporting edge of the water-closet stand against the floor and the connection of the drain outlet to the sewer line. The inner sealing section is a vent-type socket including a cylindrical, corrugated wall. Integrated hinged longitudinal and traverse web members connect the inner and outer sections to each other.

SUMMARY OF THE INVENTION

An object of the invention is to provide a gasket for sealing the outlet of water-closet so as to assure a leak-free connection, independently of the surface condition of the floor, to avoid sewage odours and leakage of liquids from the drain duct.

Another object is to provide a gasket which makes sanitary fixtures easy, quicker and cheaper to install, adaptable furthermore to different sewer piping sizes.

An further object of the invention is to provide a compound gasket for improving the bearing and securement of the fixture of the floor and including the sealer gasket of the water-closet drain for assuring good sealing of the bearing, blocking water coming from washing down the bathroom floor from leaking into the compartment formed under the stand of the bowl and stopping dirt from getting inside and into the gap between the fixture and the floor.

To attain these and other objects and advantages which may become apparent in the course of this description, the gasket for sealing the water-closet drain includes a tube the top of which is affixed to the drain-pipe of the water-closet. The tube includes a lower span fitting into the sewage pipe and provided with rings or like sealing means on the outer surface thereof for forming a fluid-tight seal against the inner surface of the sewage-pipe. According to the invention, the drainage gasket is integrated into a common one-piece compound gasket which includes an oval gasket portion through which the base of the water-closet stand rests on the floor.

In a preferred embodiment, the gasket is a single piece of moulded plastics material, such as polyvinyl, rubber or the like, integrating gasket sealing rings consisting of several rings longitudinally separated along the part of the single piece forming the tube of the gasket. In alternative embodiments, tubular bellows may be used, for instance, in place of the rings. As an accesory, the one-piece gasket may further include the conventional concentric rings as well as inner sealer means about the top end of the gasket tube for fitting onto and forming a tight seal about the hole of the drain-pipe of the water-closet.

PREFERRED EMBODIMENTS OF THE INVENTION

Figure 1:
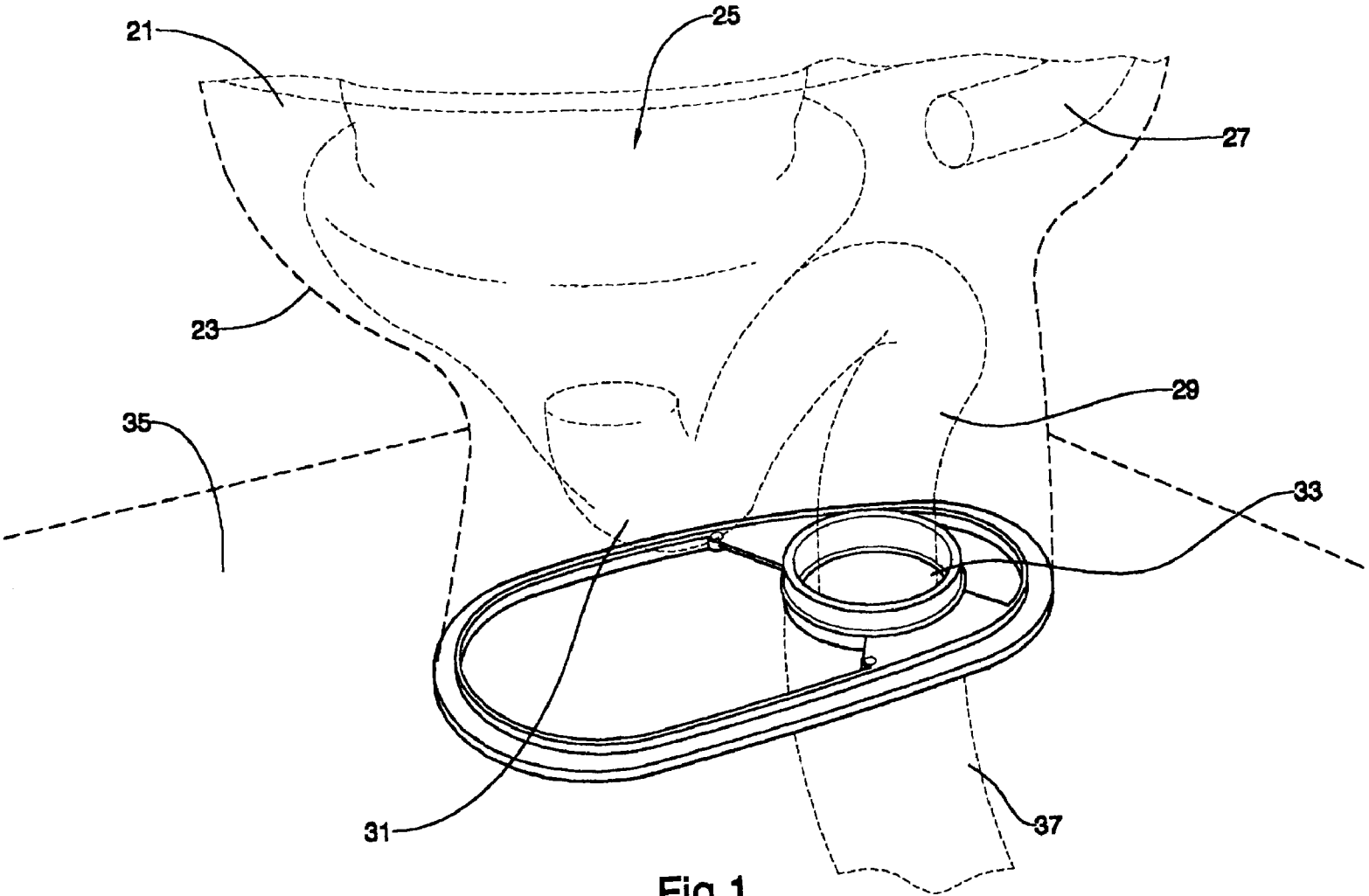
FIG. 1 is a schematic perspective view of the drain piping of a water-closet which is shown transparented for purposes of illustration wherein the present invention finds application.

A field of application of the gasket of the present invention for sealing the drain-outlet of water-closets 21 is disclosed, notwithstanding persons skilled in the art may adapt it to other uses. As illustrated in FIG. 1, the water-closet 21 comprises a bowl 23 of ceramic glass in the form of a pan 25 having an inside for receiving human wastes or exudates. A duct 27 allows water to be flushed into the pan 25 for evacuating the latter through a drain-duct 29. This drain-duct 29 conventionally includes a syphon 31 for trapping water in the pan 25 and sealing malodours in a sewage pipe 37 from emanating from the pan 25 to the bathroom.

Refering specifically to the application of the present invention, the sewage-pipe 37 has a hole at floor level 33 over which the water-closet 25 is installed such that it may be engaged by the outlet hole 33 of the W.C. drain-duct 29, using a compound gasket described in the following exemplary embodiments to prevent soiled fluid from leaking through the connection and soiling the surface of the floor 35.

Figure 3:
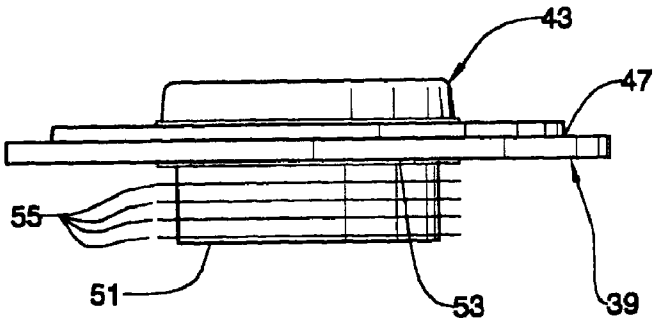
FIG. 3 is a front-back elevation view of the gasket of FIG. 2.
Figure 2:
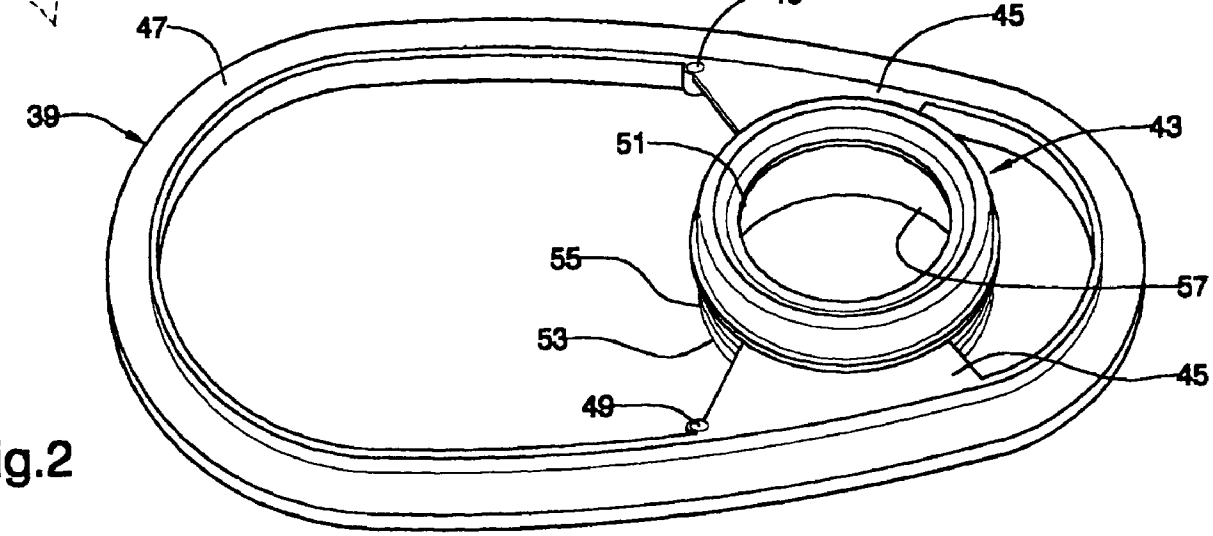
FIG. 2 is a perspective view of a one-piece compound gasket for a water-closet including the drainage sealer gasket part according to a preferred embodiment of the present invention.
Figure 4:
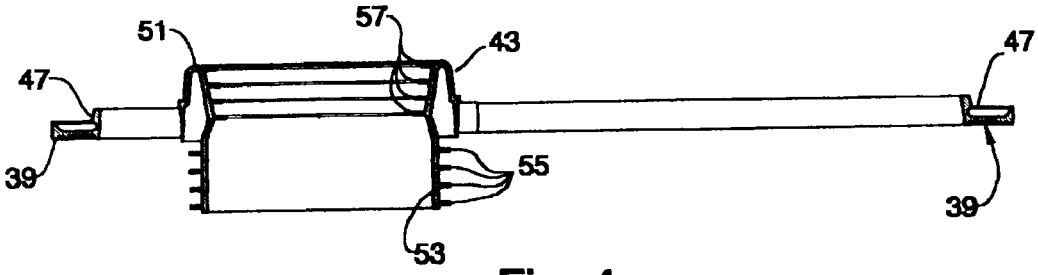
FIG. 4 is a cross-section view of the gasket of FIG. 2.

FIGS. 2, 3 and 4 illustrate in detail a preferred embodiment of a full gasket for water-closets 21, comprising a gasket outer portion 39 having an ovaloid or ring-like shape like the perimeter of the base of the stand 41 (FIG. 5), on which the bowl 23 rests or bears on the floor 35 (FIG. 1), an inner generally tubular portion 43 forming the drainage sealer gasket part and a pair of spokes 45 bridging both gasket portions 39 and 43 to form a single piece of moulded plastics material, such as polyvinyl, rubber or like material providing slightly resilient properties, with the aggregation of anti-microbic agents. The external gasket 39 is moulded with a small step 47 on its upper face so as to fit into the base of the stand 41. The spokes 45 are pierced by a pair of orifices 49 through which bolts for securing the bowl 23 to the floor 35 may be passed. Said inner tubular portion 43 has its entire outer periphery spaced apart radially inwardly from said outer gasket portion 39, said outer and inner gasket portion defining an annular space between them, and said spoke means each spaced apart from the other and each extending across said annular space with part of said annular space being on both sides of each of said spoke means.

The water-closet drainage sealer gasket 43 comprises a tube 51 of the same slightly resilient moulded plastics material which joins the drain 33 hole at the bottom of the water-closet 21 to the sewage-pipe 37. Specifically, the upper end of the tube 51 is affixed to the drain-duct 29 whereas at its bottom end, the tube 51 extends into a span 53 which plugs into the sewage-pipe 37, thereby providing the necessary connection in the water-closet 21 installation.

To improve and assure the sealability of this connection, sealer rings made of the same moulded plastics material, e.g. four longitudinally-spaced flat rings 55, are integrated onto the outer wall surface of the bottom tubular span 53. The seal-tight connection is achieved by the resilient pressure of the rings 55 against the inner wall surface of the pipe 37.

Figure 5:
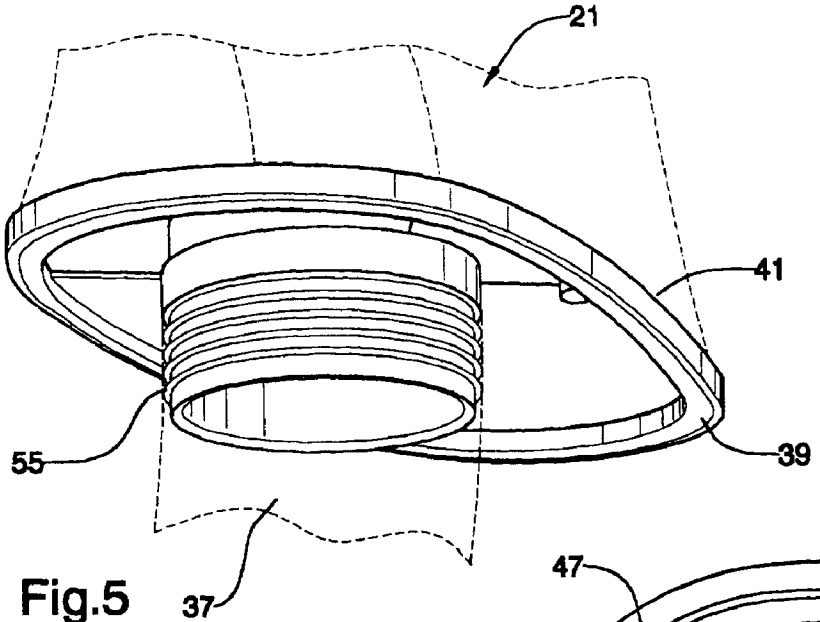
FIG. 5 is a schematic perspective underside view of the water-closet stand of FIG. 1 showing the installation of the gasket of FIGS. 2 to 4.

Carrying out the sanitary connection is easy to learn and do. The upper end 51 of the tube is fitted onto the end of the hole 33 at the end of the water-closet pipe 29. The outer gasket part 39 is fitted onto the perimeter of the base of the stand 41 before bringing the bowl 23 to rest on the floor 35 and effortlessly shoving the tubular ringed span 53 down sufficiently inside the pipe 37. Thereby securing bolts are installed through the orificies 49 in the spokes 45. FIG. 5 illustrates the final installation of the water-closet bowl 23 with the gasket.

Considering FIGS. 2, 3 and 4 again, the top end of the tube 51 may be connected in different ways to the drain duct 29. For instance, the top end of the tube 51 may terminate in the shape of a cup 58 to sealingly adapt to toilets of different sizes and shapes. The present invention also suggests doing it by plugging the hole 33 of the duct 29 inside the upper end of the tube 51, the inner wall surface of which has concave form in your superiors corners 58 what you allow to place any type of toilet adapting to this internal wall.

Figure 6:
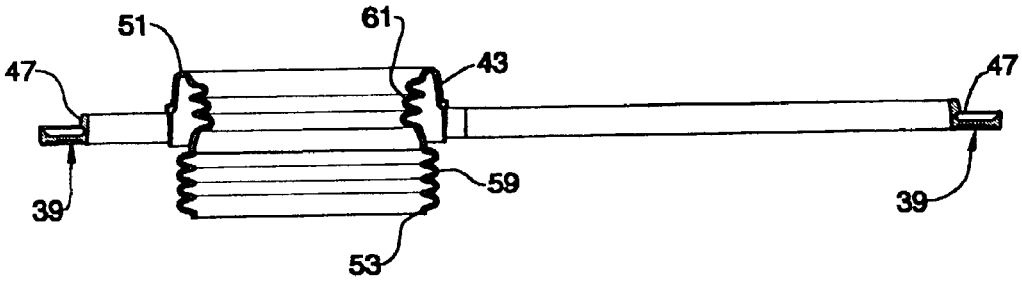
FIGS. 6-12 are cross-sections analogous to that of FIG. 4 illustrating different drainage sealer gaskets parts according to respective alternative embodiments of the present invention.

FIG. 6 illustrates a variant to the main seal-rings, consisting in forming the bottom span 53 as a bellows 59. The bellows 59 have the same purpose of the sealer means 53 of the preceding embodiment in that, when they are forced into the pipe 37, the exert an expansion pressure against the inner wall surface of the sewage pipe 37. In the same way, the additional sealer means may be formed by a bellows 61 in the upper end of the tube arranged to exert resilient pressure about the hold 33 of the drain duct 29.

Figure 7:
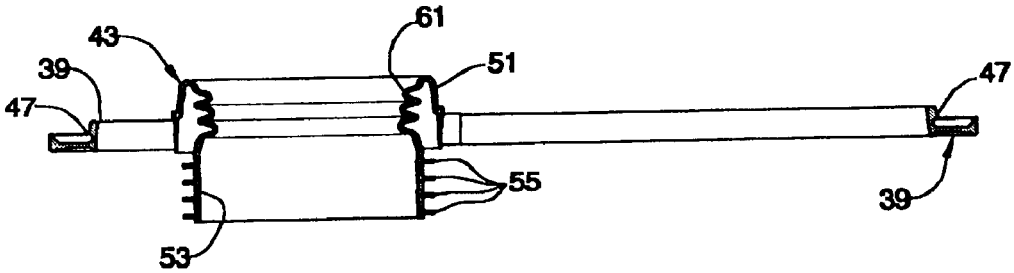
Figure 8:
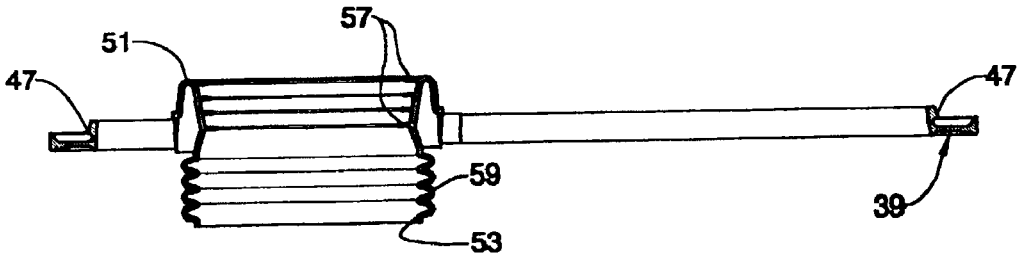

FIGS. 7 and 8 illustrate other alternative embodiment which have are foreseen although believed to be not as preferable as the preceding embodiments, consisting in different combinations of the seal-rings 55 y 57 of FIG. 5 alternated with the bellows 59 and 61 of FIG. 7.

Figure 9:
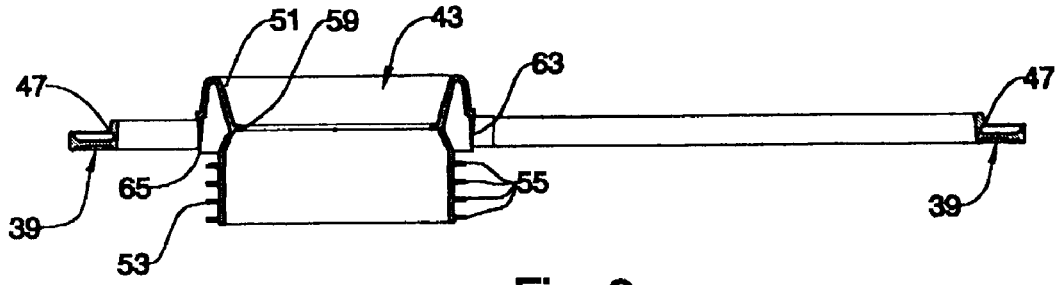
Figure 10:
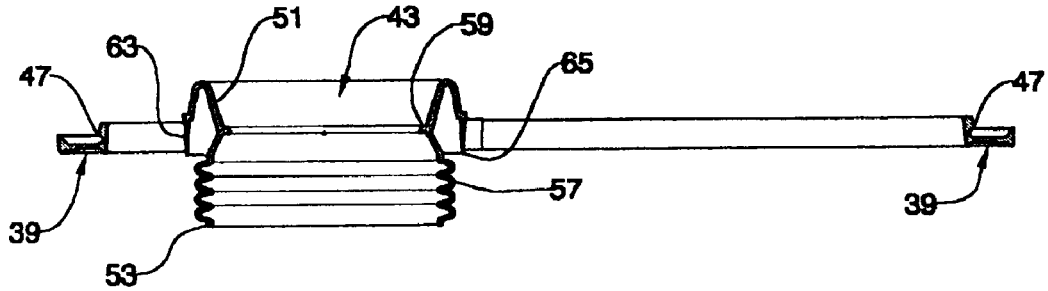
Figure 11:
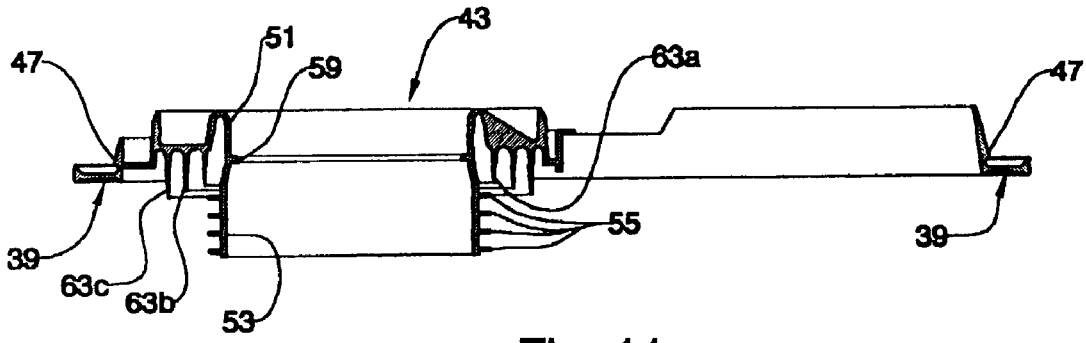
Figure 12:
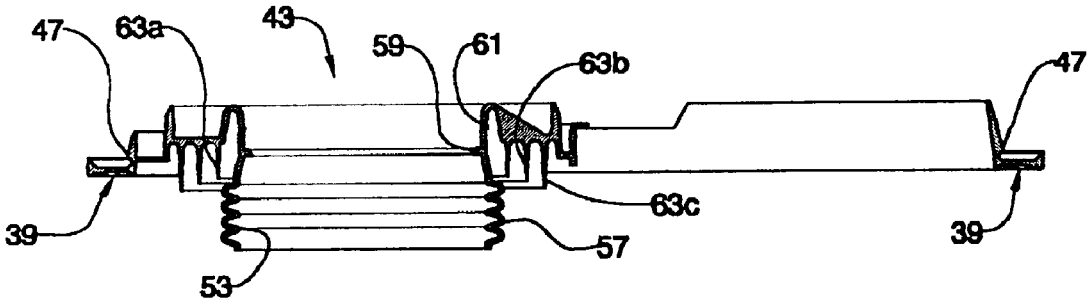

The cross-sections shown in FIGS. 9 and 10 illustrate further alternative embodiments of the drain gasket portion for the compound gasket of the invention wherein an upstanding ring 63 concentric relative to the tube 51 is integrated into the one-piece compound gasket of the invention. The upstanding ring 63 has at the bottom thereof a free circumferential edge 65 which bears on the floor 35, as in some conventional gaskets. The cross-sections shown in FIGS. 11 and 12 are respectively similar to the embodiments of FIGS. 9 and 10 except that three concentric rings 63A, 63B and 63C are integrated into the one-piece gasket to seal against the floor surface 35.

Figure 13:
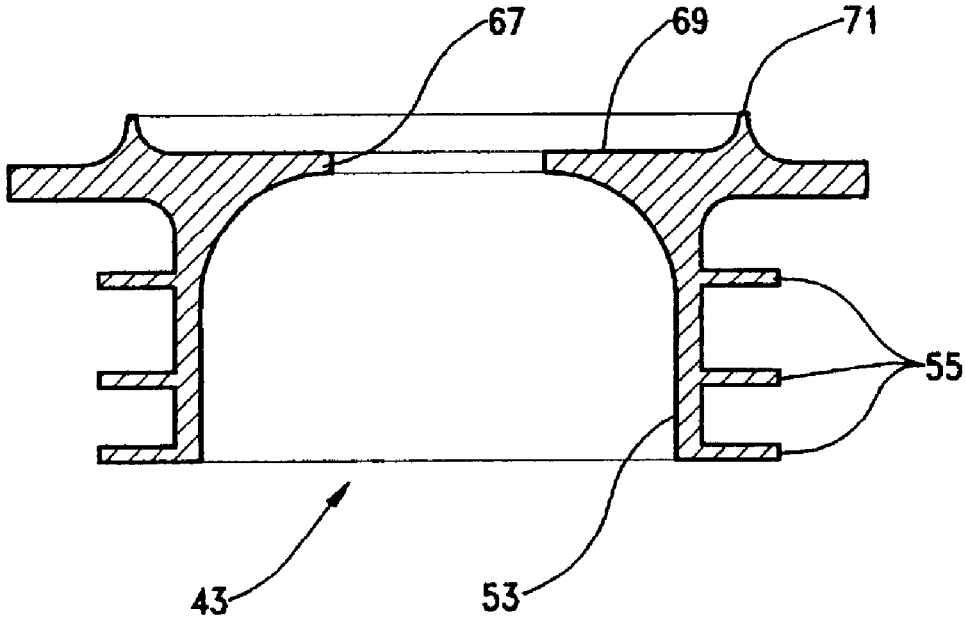
FIG. 13 is a cross-section view of an inner sealer gasket part according to a further embodiment of the invention.

FIG. 13 is a cross-section of a further embodiment of a drain sealer gasket part 49 which, as in the other embodiments, may be integrated into a single piece with the stand gasket part 39. The upper portion of the gasket 49 depicted in FIG. 13 is an integrated disk 67 featuring a generally flat face 69 except for an upstanding ring-shaped ridge 71 designed to fit around the outer edge 33 of the bowl drain-duct 29. Installation is simplified in this case since there is no need to first fit the gasket 43 about the drain outlet pipe 29.

The lower portion of the gasket 43 has three flat rings 55. The gasket 43 is installed and works essentially in the same way as the other embodiments, sealing the drain connection once the bowl 23 is placed thereon and secured to the floor 35.

Of course, changes, variations and aggregations may be made to the multiple embodiment describe above, without departing from the scope nor the spirit of the invention. The same has been described by way of preferred embodiments specifically for water-closets, however those skilled in the art may suit it to other applications without departing from the purview of the invention as set forth in the appended claims. For example, the inner gasket 43 may be independent or devoid of the outer gasket 39 or the four rings 57 or the bellows 61 near the upper end of the tube 51 be increased, reduced or omitted for practical reasons, if any, among other variations.

I claim:

1. A gasket for sealing the connection between a sanitary fixture such as a water closet and a building floor having a sewage pipe therein, said sanitary fixture having a stand part with a bottom surface defining an outer perimeter and having a drain duct terminating in an outlet for placement over and adjacent said building sewage pipe when said fixture is installed on said building floor, said building sewage pipe having an inner wall surface, said gasket comprising:

one piece unified molded gasket of resilient material comprising:

a. an outer gasket part having a substantially annular shape generally adapted to fit between and engage said bottom surface of said sanitary fixture stand part and said building floor, wherein the outer gasket part is molded with a small step on its upper face to fit into the base of the water closet;

b. an inner gasket part for sealing the connection between said sanitary fixture drain outlet duct and said building sewage pipe, said inner gasket part having a tubular shape whose entire outer periphery is spaced apart radially inwardly from said outer gasket part, such that there is an annular space between said outer and inner gasket parts and completely surrounding said inner gasket part, c. two spoke means extending generally radially across and bridging said annual space between said outer and inner gasket parts, one of said two spoke means being spaced apart circumferentially from the other, said annular space extending axially completely through said gasket so that said inner part is connected to said outer part only by said spoke means, wherein each of said spoke means includes at least one orifice passing axially through the spoke means, d. said inner gasket part further comprising:

i. an upper tubular portion having an upstanding ridge for engaging a surface of the sanitary fixture, and ii. a lower tubular section extending downward from the upper tubular portion for insertion into said building sewage pipe, said lower tubular section having an outer surface provided with radially outward extending and elastically deformable integrated sealer rings for resiliently sealing against said inner wall of said building sewage pipe.

2. A gasket according to claim 1, wherein said upper tubular portion has a top end with a generally flat flange extending radially inward and defining a central aperture.

3. A gasket according to claim 1 wherein each of said spoke means has the shape of an elongated strip extending between said inner and outer gasket parts.

4. A gasket for sealing the connection between a sanitary fixture, such as a water closet, and a building floor having a sewage pipe therein, said sanitary fixture having a stand part with a bottom surface defining an outer perimeter and having a drain duct terminating in an outlet for placement over and adjacent said building sewage pipe when said fixture is installed on said building floor, said building sewage pipe having an inner wall surface, said gasket comprising:

one piece unified molded gasket of resilient material comprising:

a. an outer gasket part having a substantially annular shape generally adapted to fit between and engage said bottom surface of said sanitary fixture stand part and said building floor, wherein the outer gasket part is molded with a small step on its upper face to fit into the base of the water closet;, b. an inner gasket part for sealing the connection between said sanitary fixture drain outlet duct and said building sewage pipe, said inner gasket part having a tubular shape whose entire outer periphery is spaced apart radially inwardly from said outer gasket part, such that there is an annular space between said outer and inner gasket parts and completely surrounding said inner gasket part, said outer periphery includes a plurality of integrated elastically deformable sealer rings, c. two spoke means extending generally radially across and bridging said annual space between said outer and inner gasket parts, one of said two spoke means being spaced apart circumferentially from the other of said two spoke means, said annular space extending axially completely through said gasket so that said inner part is connected to said outer part only by said spoke means, d. said inner gasket part further comprising:

i. an upper tubular portion having an upstanding ridge for engaging a surface of the sanitary fixture, and ii. a lower tubular section extending downward from the upper tubular portion for insertion into said building sewage pipe, said lower tubular section having an outer surface provided with radially outward extending and elastically deformable integrated sealer rings for resiliently sealing against said inner wall of said building sewage pipe.

5. A gasket according to claim 4, where in the substantially annular shape is substantially oval.

* * * * *